United States Patent [19]

Bruggeman

[11] Patent Number: 5,029,779

[45] Date of Patent: Jul. 9, 1991

[54] WELDED NETTING WITH DEFORMED STRETCHING WIRES

[75] Inventor: Frans Bruggeman, Kluisbergen, Belgium

[73] Assignee: N.V. Bekaert S.A., Zwevegem, Belgium

[21] Appl. No.: 351,341

[22] Filed: May 15, 1989

[30] Foreign Application Priority Data

Jun. 6, 1988 [NL] Netherlands ..... 8801451

[51] Int. Cl.[5] ..... B21F 19/00; B21F 27/10; B21F 27/12; E04H 17/02

[52] U.S. Cl. ..... 245/4; 245/2; 245/8; 256/33; 140/3 C; 140/3 R; 140/7; 140/9; 140/112

[58] Field of Search ..... 140/3 R, 3 C, 4–9, 140/107, 112; 245/1, 7–10, 4; 256/32, 33, 36–39, 45

[56] References Cited

U.S. PATENT DOCUMENTS

| | | | |
|---|---|---|---|
| 606,421 | 6/1898 | Kitselman | 245/7 |
| 912,950 | 2/1909 | Gibert | 245/7 |
| 1,467,416 | 9/1923 | Barnes . | |
| 3,010,493 | 11/1961 | Fingerut | 140/112 |
| 3,503,590 | 3/1970 | Buysens | 256/32 |
| 3,578,036 | 5/1971 | Francois | 140/112 |
| 3,837,372 | 9/1974 | Bernot | 140/112 |
| 3,838,837 | 10/1974 | Tolliver | 245/1 |
| 3,841,591 | 10/1974 | Tolliver | 245/1 |
| 3,844,510 | 10/1974 | Tolliver | 245/1 |
| 3,899,227 | 8/1975 | Harig | 308/237 R |
| 4,074,731 | 2/1978 | Archer | 140/112 |

FOREIGN PATENT DOCUMENTS

| | | | |
|---|---|---|---|
| 307311 | 8/1918 | Fed. Rep. of Germany | 140/9 |
| 373506 | 5/1907 | France . | |
| 514477 | 3/1921 | France . | |
| 1001429 | 10/1951 | France | 256/33 |
| 1061340 | 4/1954 | France . | |
| 2171077 | 9/1973 | France . | |
| 2584957 | 1/1987 | France . | |
| 206535 | 9/1986 | Japan | 140/3 R |
| 6402649 | 9/1964 | Netherlands . | |
| 725286 | 3/1955 | United Kingdom | 140/71 R |
| 826218 | 12/1959 | United Kingdom | 140/112 |
| 2177730A | 1/1987 | United Kingdom | 140/112 |

*Primary Examiner*—Robert L. Spruill
*Attorney, Agent, or Firm*—Foley & Lardner

[57] ABSTRACT

This invention relates to a sheet-shaped welded netting of metal at least comprising mesh-forming wires extending longitudinally of the sheet and/or mesh-forming wires extending transversely of the sheet as well as several deformed stretching wires extending longitudinally of the sheet which can stretch under tensile stress and which may or may not have the function of mesh-forming wires extending longitudinally of the sheet, the deformations in the stretching wires substantially lying in the plane of the netting and the stretching wires displaying a regular arrangement of identical patterns longitudinally of the sheet, whereby the deformation of the stretching wires is such that the ratio of the maximum dimension (B) of a mesh longitudinally of the sheet to the distance (A) between two consecutive maxima in a deformed stretching wire is at least about three, that the maxima of two adjacent stretching wires of the welded netting may or may not have the same position with respect to the longitudinal direction of the netting and that the arrangement of identical patterns of each of the stretching wires is randomly positioned with respect to the arrangement of the meshes in the welded netting.

7 Claims, 10 Drawing Sheets

WELDED NETTING WITH DEFORMED STRETCHING WIRES

BACKGROUND OF THE INVENTION

1. Field of the Invention

The invention relates in the first place to a sheet-shaped welded netting of metal at least comprising mesh-forming wires extending longitudinally of the sheet and/or mesh-forming wires extending transversely of the sheet as well as several deformed stretching wires extending longitudinally of the sheet which can stretch under tensile stress and which may or may not have the function of mesh-forming wires extending longitudinally of the sheet, the deformations in the stretching wires substantially lying in the plane of the netting and the stretching wires displaying a regular arrangement of identical patterns longitudinally of the sheet.

2. Discussion of Related Art

Such welded netting is known from French patent application No. 2 584 957.

In this publication is described a welded wire netting wherein stretching wires are present that are deformed on the one hand to be able to stretch the netting taut and on the other hand to make the netting resistant to deformation in taut condition when the netting is used for a fence, for instance.

In the French publication, the deformations are always applied in phase with the meshes of the netting; i.e., the deformation pattern is always positioned symmetrically with respect to the mesh pattern.

Such a situation can be achieved, for instance, by starting from undeformed stretching wires when manufacturing the welded netting and by deforming the former only after the stretching wires have been connected to the mesh-forming wires through welding.

When starting from stretching wires that have already been deformed beforehand, the latter have to be positioned very accurately with respect to the mesh-forming wires as a result of which an extremely accurate dimensioning of the mesh-forming process has to go together with an extremely accurate positioning of the stretching wires that have already been deformed beforehand.

Such method, if feasible at all, is extremely difficult and costly.

OBJECTS AND SUMMARY OF THE INVENTION

It is the object of the present invention to provide a welded netting in which the aforesaid positioning problem of the stretching wires no longer occurs and which nevertheless makes it possible to start from stretching wires of a type deformed beforehand.

To that end, the welded netting of the aforesaid type is characterized in accordance with the invention in that the deformation of the stretching wires is such that the ratio of the maximum dimension of a mesh longitudinally of the sheet to the distance between two consecutive maxima in a deformed stretching wire is at least about three, that the maxima of two adjacent stretching wires of the netting may or may not have the same position with respect to the longitudinal direction of the netting and that the arrangement of identical patterns of each of the stretching wires is randomly positioned with respect to the arrangement of the meshes in the welded netting.

Indeed, it has been found that if the period of the deformations in a stretching wire is made sufficiently small, an out-of-phase course of the stretching wire and the mesh pattern of the netting is no longer felt to be awkward.

An out-of-phase course of the stretching wires and the meshes of the prior-art netting described hereinbefore is generally very awkward and major efforts are therefore being made to guarantee phase coincidence of the stretching wires and the mesh pattern.

Netting of the type as described hereinbefore is especially very suitable for fencing purposes, where a good tensionability, a good resistance to deformation and a uniform aspect are important.

In the following description, the deformation criterion used will always be the distance between two consecutive maxima in a deformed stretching wire. In this case, a maximum is understood to mean the maximum deviation of the deformed stretching wire with respect to the neutral line of said stretching wire. The maxima may be located on one side of said central line as well as on either side.

If the deformation of a stretching wire were sine shaped, the distance between two maxima would, as a consequence, equal half a period of the sine function.

In the aforesaid characteristic, the ratio of the maximum dimension of a mesh longitudinally of the netting sheet to the distance between two consecutive maxima is deliberately defined as at least about 3. The meaning of this is that when applying such a degree of deformation, the exact ratio between the dimensions becomes less important as, essentially, each stretching wire can be applied longitudinally of the netting in an arbitrary way irrespective of the periodicity of the netting itself. Consequently, a value of said ratio equalling 2.9 will give as good results as a ratio of 3.0 or 3.1.

In particular, however, a ratio will be chosen that comes to at least about 5.

As regards the amplitude of the patterns of each stretching wire in the plane of the welded netting sheet, each pattern of a stretching wire is such that the deviation at a maximum with respect to the central line of this stretching wire is not more than 10% of the maximum dimension of a mesh of the welded netting transversely of the sheet.

Preferably, the deformation of each stretching wire is such that the length of a unit part of it longitudinally of the sheet comes to at least 90% of the length of the unit part in its undeformed condition, that is the actual length of the wire between successive maximum.

Advantageously, the distance between two adjacent stretching wires in the netting comes to less than 250 mm.

Further, it is noted that a stretching wire is generally a deformed wire substantially extending longitudinally of the netting and which wire may or may not be a mesh-forming wire. It means that the welded netting can be formed of pattern wires, the stretching wires being separate or additional wires. However, the welded netting can also be composed with the stretching wires having the function of mesh-forming wire as well as of stretching wire.

Such forms of netting will be discussed later.

Very advantageously, in the welded netting in accordance with the present invention, at least two stretching wires are present in the peripheral areas of the netting extending with an in-between distance that is smaller than half the maximum mesh dimension transversely of the sheet. An arrangement of such stretching wires extending relatively close to one another in the peripheral area of the netting gives the netting an extremely good tensionability and a great stability.

As indicated hereinbefore, a precise positioning of the different stretching wires with respect to one another as well as a symmetrical placing of each of the stretching wires with respect to the mesh periodicity are no longer necessary because of the short distance between the maxima of the stretching wires.

The invention is also embodied in a method for making a welded netting by positioning mesh-forming wires extending longitudinally of the sheet and/or mesh-forming wires extending transversely of the sheet as well as several deformed stretching wires extending longitudinally of the sheet with respect to one another and by connecting them through welding the method is characterised in that stretching wires are applied the deformation of which is such that the ratio of the maximum dimension of a mesh longitudinally of the sheet to the distance between two consecutive maxima in a deformed stretching wire comes to at least about 3, the arrangement of identical patterns in the wire being randomly positioned with respect to the arrangement of the meshes in the netting.

Therefore, such a netting is made by starting from stretching wires deformed beforehand, taking care that the ratio of the mesh dimension longitudinally of the netting sheet to the distance between two consecutive maxima of a stretching wire is at least about 3 and it being possible for each stretching wire longitudinally of the netting sheet to be placed at random.

Advantageously, the method described hereinbefore is carried out in such a way that first a basic netting with meshes is formed by starting from specific mesh-forming wires, then applying the stretching wires in a separate welding operation, whereby only the distribution of the stretching wires over the width of the sheet needs to be regulated as far as positioning is concerned. A positioning of each deformed stretching wire longitudinally of the netting sheet with a view to the periodicity of the netting is no longer critical as a result of the distance between the maxima as described hereinbefore.

When carrying out the method indicated hereinbefore, use is generally made of spot welding electrodes, for instance, the surface of which is so large that a good welded connection can be obtained irrespective of the position of, for instance, a stretching wire with respect to a transverse wire.

BRIEF DESCRIPTION OF THE DRAWINGS

The invention will hereinafter be illustrated with reference to the drawings wherein.

DETAILED DESCRIPTION OF THE PREFERRED EMBODIMENTS

Figure 1:
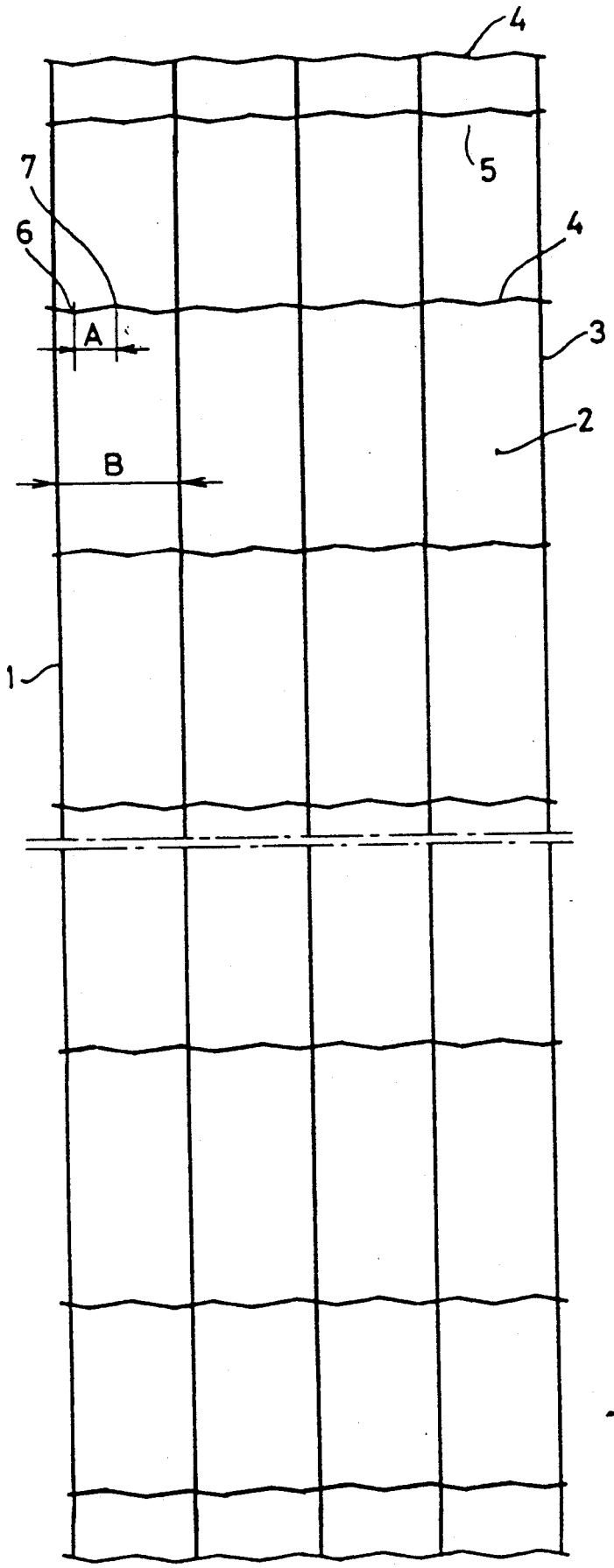
FIGS. 1 to 6 inclusive show embodiments of the netting in accordance with the invention with rectangular meshes.

FIG. 1 shows a netting 1 with rectangular meshes formed by welding together straight undeformed mesh-forming wires 3 extending transversely of the netting and deformed stretching wires 4 extending longitudinally of the netting which at the same time have the function of mesh-forming wires. This way, meshes 2 are formed and it can be seen that an extra stretching wire 5 is applied for reinforcement in the peripheral areas of the netting.

The stretching wire 4 has maxima 6 and 7 which have an in-between distance A, the maximum mesh distance longitudinally of the netting sheet being indicated with B. The ratio of B/A is about 3.

Each stretching wire 4, 5 shows a regular arrangement of identical patterns longitudinally of the sheet. These stretching wires 4, 5 are formed on commonly known machines, e.g. by guiding the wires between a pair of crimping cylinders or wheels. The maxima 6 and 7 of two adjacent stretching wires 4 and 5 may have the same position with respect to the longitudinal direction of the welded netting; however, this is not necessary. The arrangement of the identical patterns of each of the stretching wires 4 and 5 is randomly positioned with respect to the arrangement of the meshes 2 of the welded netting 1.

Advantageously, such a netting is applied as fencing; the wire-netting product formed is often provided with a corrosion-resistant zinc layer whereupon a plastic layer, a sintered coloured PVC layer for instance, is applied if so desired.

Figure 2:
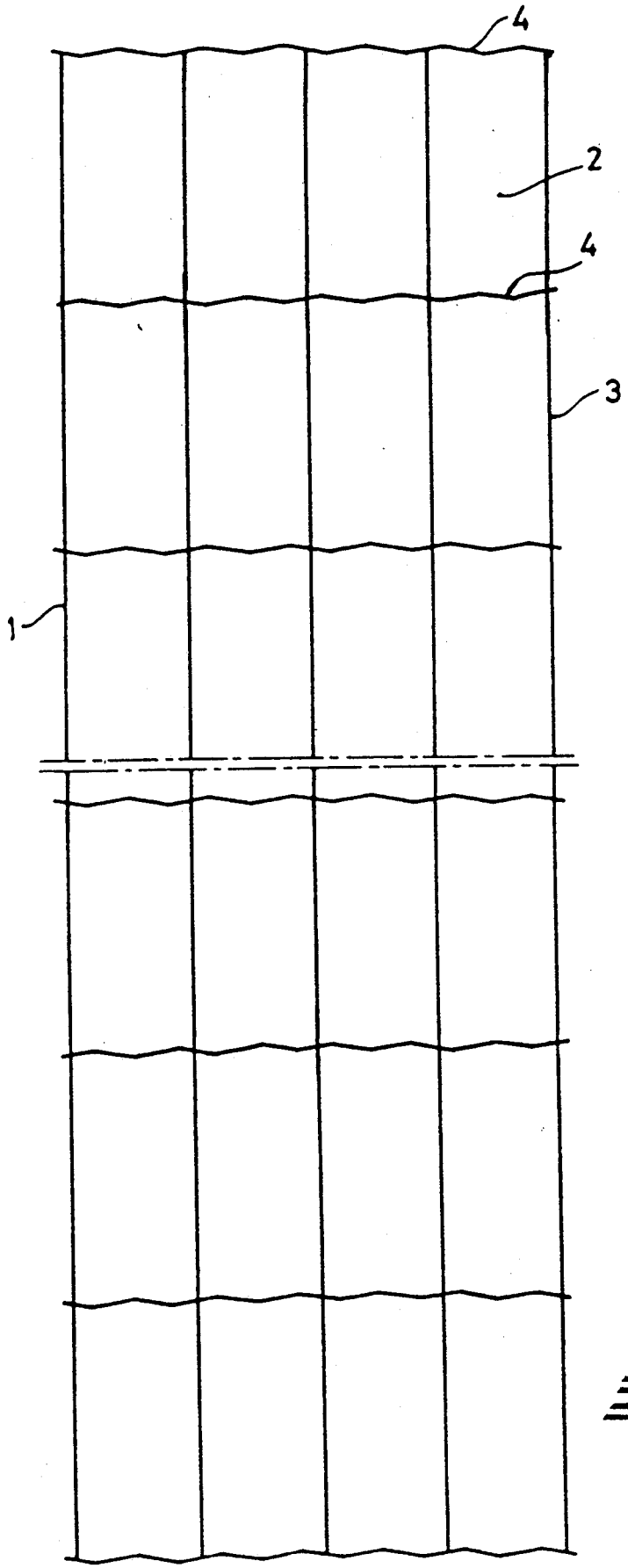

FIG. 2 is a netting as shown in FIG. 1; the extra stretching wires 5 are missing, however.

Figure 3:
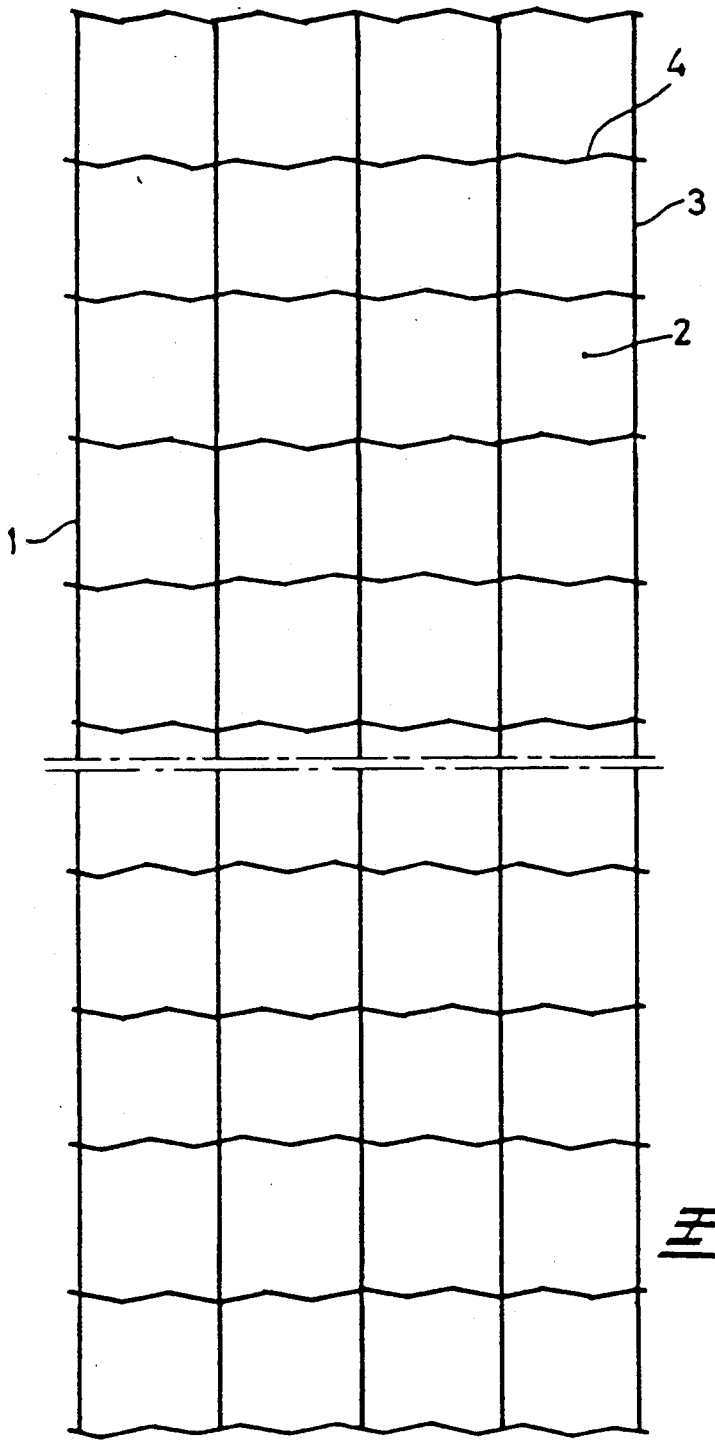

FIG. 3 is a netting as in FIG. 2, the rectangular shape of the meshes 2 being a square shape, however.

Figure 4:
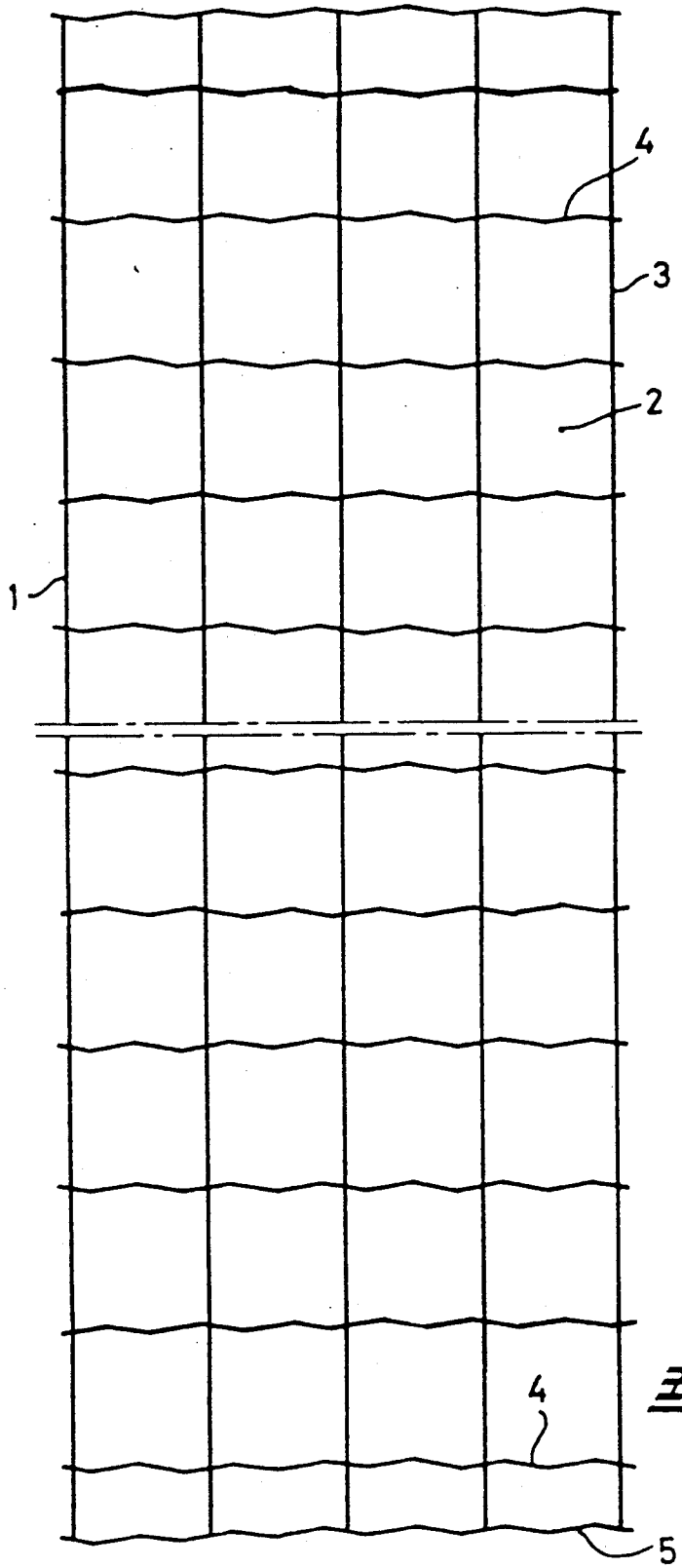
Figure 5:
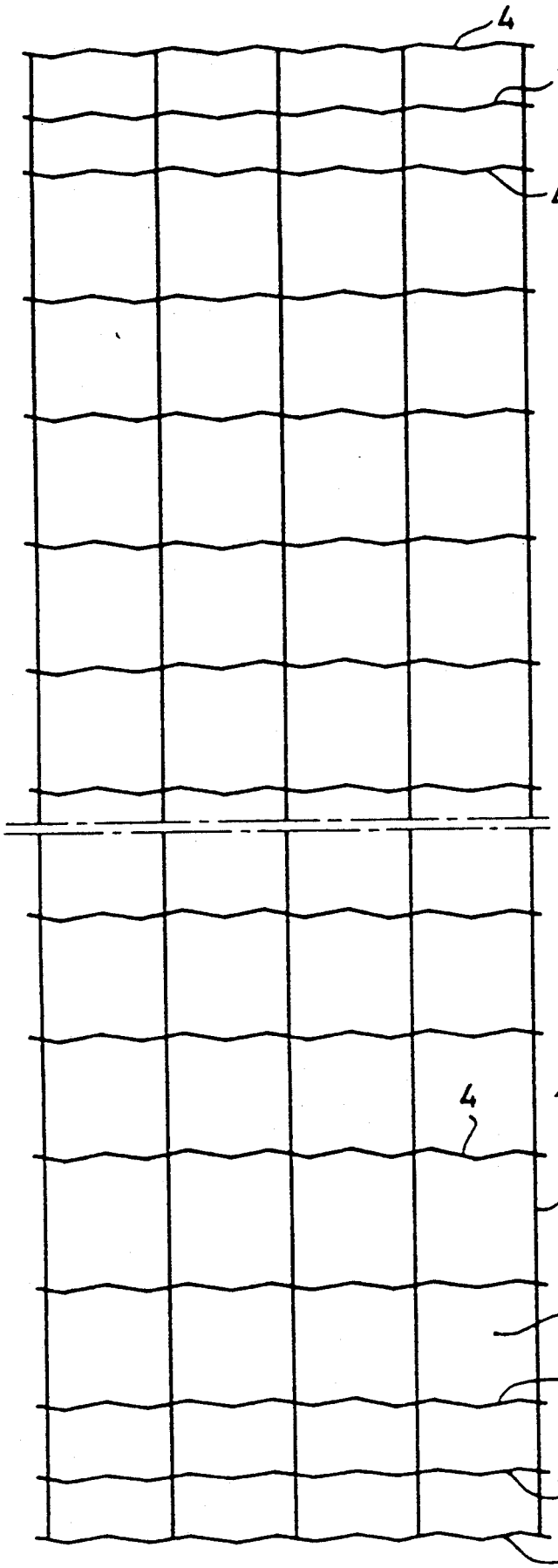

FIG. 4 shows a netting as in FIG. 3, extra stretching wires 5 having been incorporated at the edges, however, whereas FIG. 5 shows a netting as in FIG. 4, the extra stretching wire dividing the outmost meshes 2 into two approximately equal halves.

Figure 6:
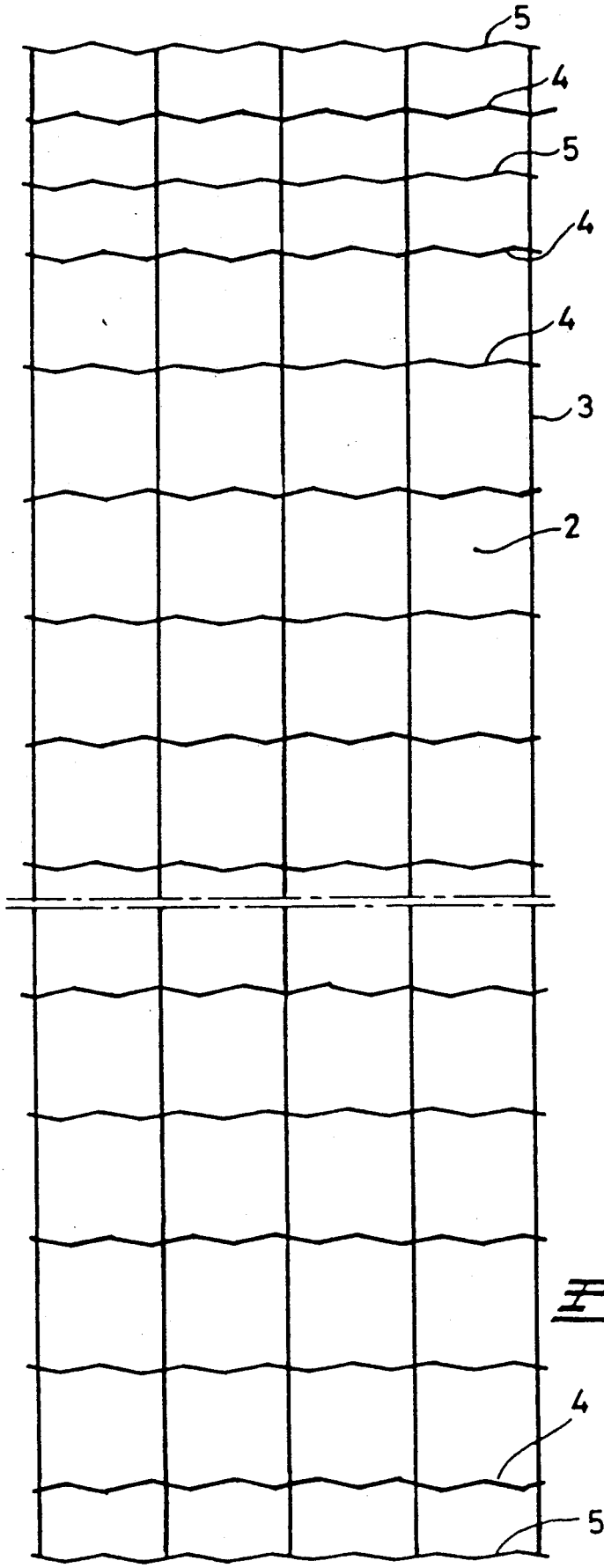

FIG. 6 shows another variant with two extra reinforcement wires 5 at the top of the netting and one reinforcement wire at the bottom of the netting.

Figure 7:
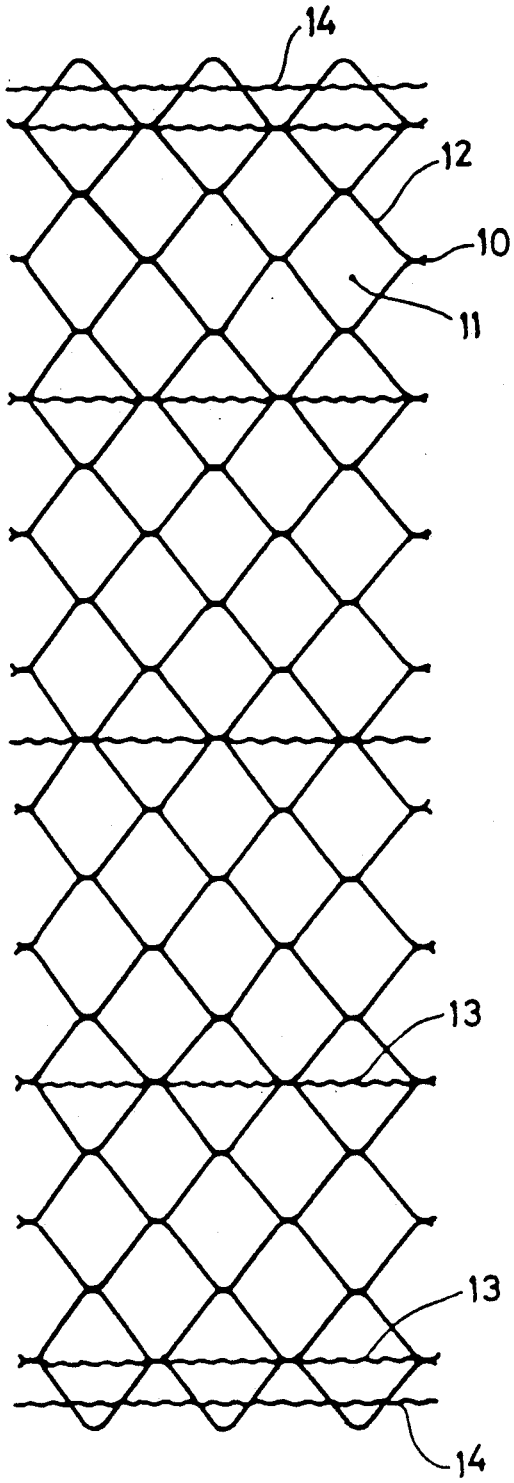
FIG. 7 shows a netting with rhombic meshes.

FIG. 7 shows a so-called diamond-mesh netting 10 with meshes 11 that are formed by starting from mesh-forming wires 12. Stretching wires 13 have been incorporated into the netting and in this case as well, extra stretching wires 14 are present in the peripheral area of the netting. These stretching wires 13 and 14 correspond to the stretching wires 4 and 5 of the embodiments, shown in FIGS. 1 to 6. However, the stretching wires 13 and 14 are not mesh-forming wires. These stretching wires 13 and 14 are separate or additional wires.

Figure 8:
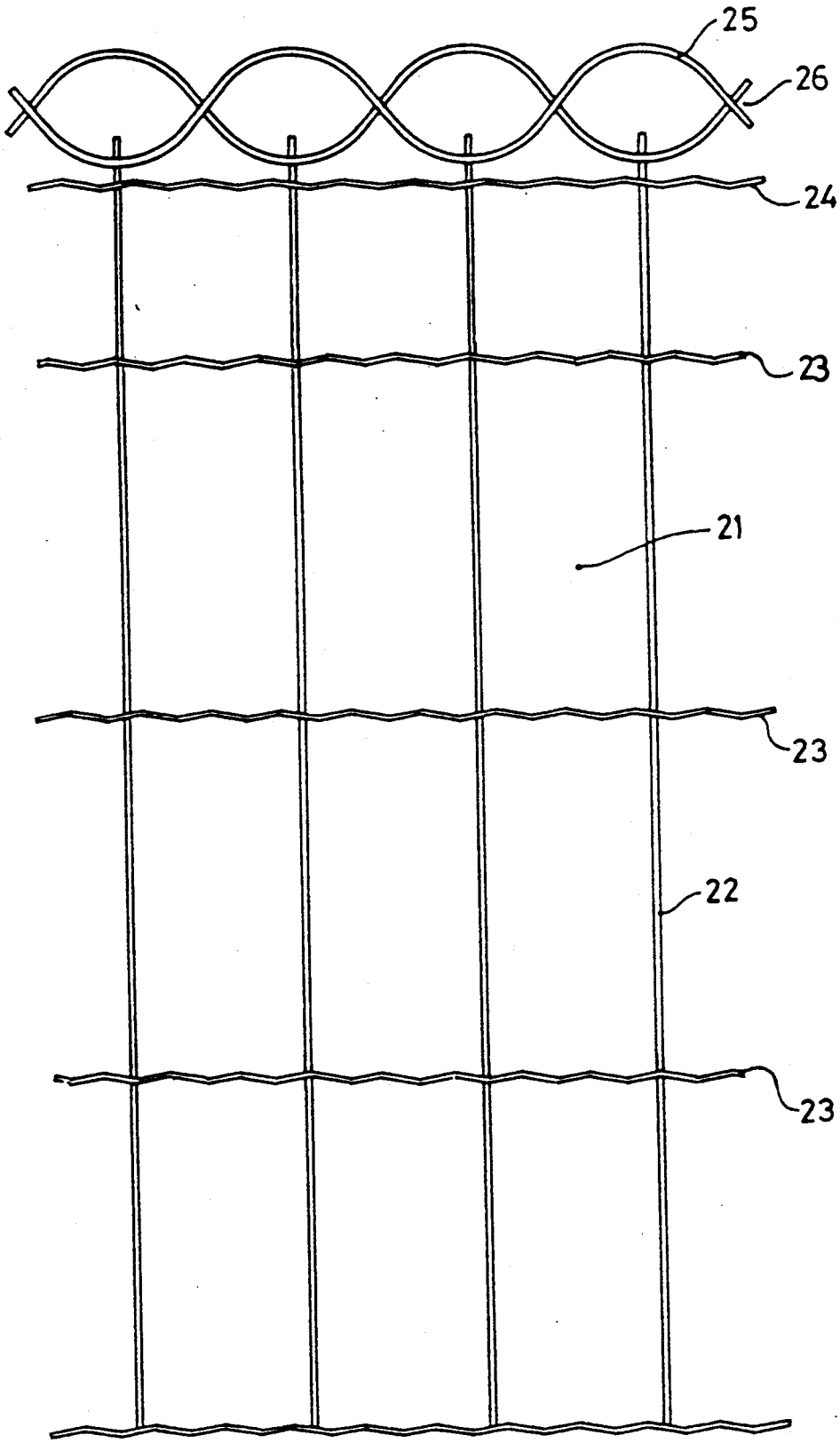
FIG. 8 shows a netting with rectangular meshes and a selvedge presenting rounded shapes.

FIG. 8 shows a netting substantially corresponding to the netting as shown in FIG. 1. The meshes 21 have a rectangular shape that is obtained by composing the netting of transversely extending wires 22 and deformed stretching wires 23. In this case, an extra stretching wire 24 has been incorporated into the upper peripheral area of the netting furthermore incorporating a decorative part composed of undulatory wires 25 and 26 that are connected to one another and to transverse wires 22 through welding. The stretching wires 23 and 24 correspond to the stretching wires 4 and 5 of the embodiments, shown in FIGS. 1 to 6.

Figure 9:
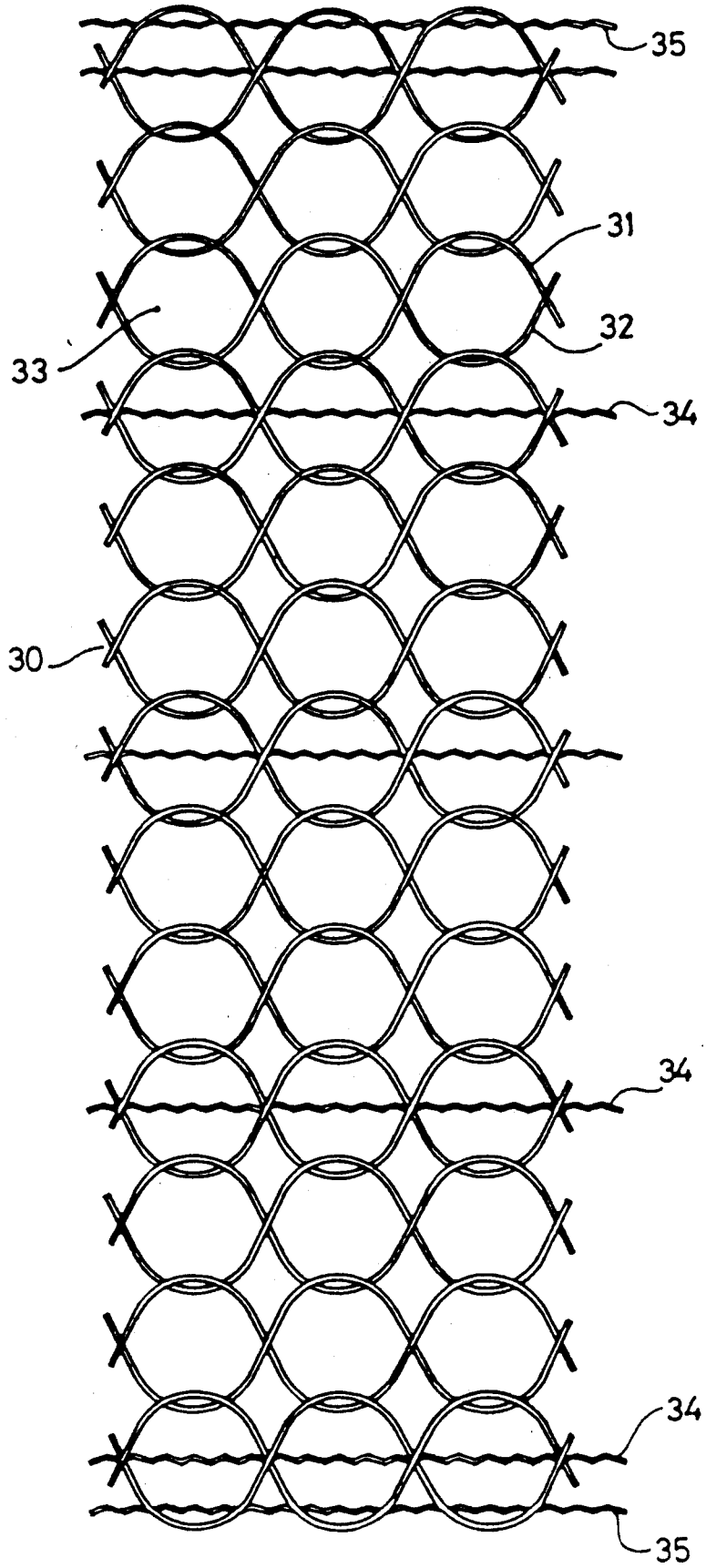
FIG. 9 shows a welded netting formed of undulatory mesh-forming wires extending longitudinally of the netting.

FIG. 9 shows a netting type substantially obtained by welding together undulatory wires 31 and 32 extending longitudinally of the netting sheet as a result of which meshes 33 are formed. The longitudinally extending deformed stretching wires 34 are applied during the netting-forming process, but advantageously after the formation of this netting; extra stretching wires 35 being present in the peripheral areas. In the figure, the stretching wires 34 are drawn exactly at the intersections of the longitudinal wires 31 and 32. It will be clear that such a positioning is not very critical when applying spot welding electrodes with a sufficiently large surface. Slight shifts with respect to the intersection are allowable. The stretching wires 34 and 35 correspond to the stretching wires 13 and 14 of the embodiment shown in FIG. 7.

Figure 10:
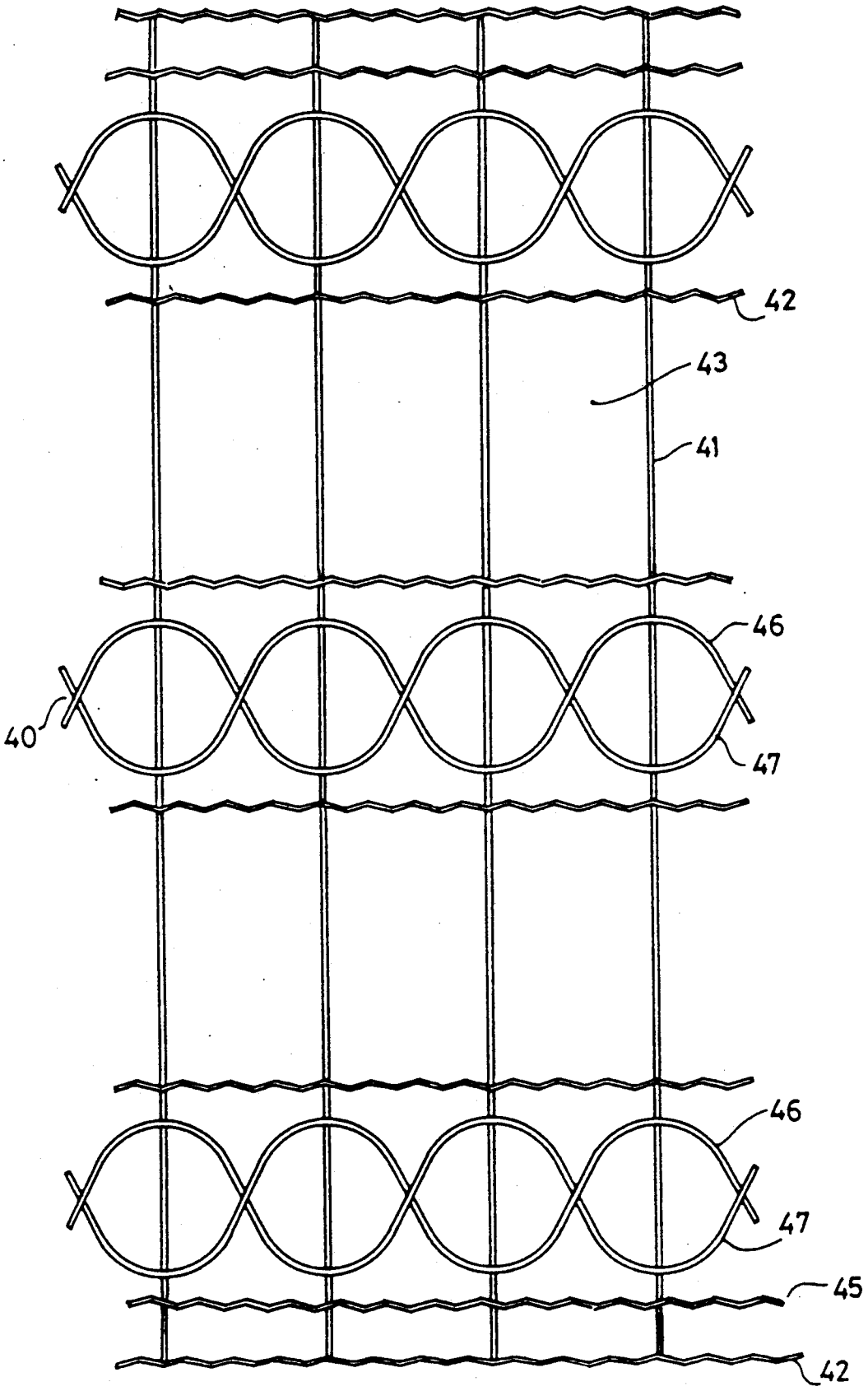
FIG. 10 represents a netting which consists of a combination of rectangular meshes and round mesh shapes.

Finally, FIG. 10 shows yet another netting 40 with rectangular meshes 43 that is composed of transverse wires 41 and longitudinal wires 42 in the form of stretching wires. Further, ornaments composed of undulatory deformed wires 46 and 47 have been incorporated into a number of areas between two stretching wires. An extra stretching wire 45 is applied for reinforcement in the peripheral areas of the netting 40. The stretching wires 42 and 45 correspond to the stretching wires 4 and 5 of the embodiment shown in FIG. 1.

I claim:

1. A sheet-shaped welded metal netting, comprising:

a plurality of mesh-forming wires; and a plurality of substantially parallel, deformed nonrectilinear stretching wires extending in a longitudinal direction relative said sheet-shaped netting;

said stretching wires having substantially identical patterns of evenly-spaced deformations each having successive maxima;

said stretching wires being weld-connected to said mesh forming wires;

wherein the longitudinal distance between successive maxima of each of said stretching wires is at least 90% of the length of the respective stretching wire between said maxima; and wherein the maxima of at least some stretching wires are randomly distributed along the longitudinal direction of said mesh so that the maxima of at least some successive stretching wires are out of phase with one another.

2. Welded netting according to claim 1, wherein the deformation of a stretching wire is such that the deviation at a maximum with respect to the central line of said stretching wire is not more than 10% of the maximum distance between successive stretching wires transversely of the welded netting sheet.

3. Welded netting according to claim 1 wherein the distance between two successive stretching wires is less than 250 mm.

4. Welded netting according to claim 3, wherein at least two stretching wires are present in each of the transversely peripheral areas of the netting separated by a distance that is smaller than half the maximum distance between successive stretching wires transversely of the sheet.

5. Welded netting according to claim 1 wherein the netting is provided with a corrosion-resistant metal layer with a sintered plastic layer.

6. Welded netting according to claim 1, wherein the ratio of a maximum longitudinal width of the mesh formed by said mesh forming wires to a longitudinal distance between successive maxima of a given stretching wire is at least about 3.

7. Welded netting according to claim 6, wherein said ratio is at least about 5.

* * * * *